US012234752B2

(12) United States Patent
Henke

(10) Patent No.: US 12,234,752 B2
(45) Date of Patent: Feb. 25, 2025

(54) WATER-INJECTED STEAM ENGINE

(71) Applicant: ENEXSYS RESEARCH INC., Abbotsford (CA)

(72) Inventor: James Henke, Abbotsford (CA)

(73) Assignee: ENEXSYS RESEARCH INC., Abbotsford (CA)

( * ) Notice: Subject to any disclaimer, the term of this patent is extended or adjusted under 35 U.S.C. 154(b) by 0 days.

(21) Appl. No.: 18/293,672

(22) PCT Filed: Oct. 6, 2021

(86) PCT No.: PCT/CA2021/051411
§ 371 (c)(1),
(2) Date: Jan. 30, 2024

(87) PCT Pub. No.: WO2023/056542
PCT Pub. Date: Apr. 13, 2023

(65) Prior Publication Data
US 2024/0337204 A1 Oct. 10, 2024

(51) Int. Cl.
*F01K 7/12* (2006.01)

(52) U.S. Cl.
CPC ..... *F01K 7/12* (2013.01)

(58) Field of Classification Search
CPC ..... F01K 7/12; F01K 7/02; F01K 7/226
See application file for complete search history.

(56) References Cited

U.S. PATENT DOCUMENTS 3,720,188 A 3/1973 Mead
4,599,859 A 7/1986 Urso
6,468,061 B2 * 10/2002 Dyktynski ..... F04C 2/3566 418/187
6,470,668 B2 10/2002 Payling et al.
6,939,117 B2 * 9/2005 Wheeler ..... F01C 21/18 418/268
7,713,042 B1 * 5/2010 Rodgers ..... F01C 21/18 123/243
8,505,301 B2 8/2013 Yamamoto et al.
8,689,765 B2 * 4/2014 Pekrul ..... F01C 21/0863 418/133

FOREIGN PATENT DOCUMENTS

CN 102392701 B 3/2015

* cited by examiner

*Primary Examiner* — Shafiq Mian
(74) *Attorney, Agent, or Firm* — KIRTON McCONKIE; Evan R. Witt

(57) ABSTRACT

A steam engine (10) has an engine case (14), a stator (20) with a radially-inner surface (52) with a plurality of recesses (54), a steam generator (12) and a rotor 5 (22) that has a steam distribution chamber (44) arranged to receive steam from the generator and a plurality of steam distribution channels (46) having outlets (50) for the flow of steam into the stator recesses (54). The rotor has pressure relief ports (60) for the flow of steam from the recesses (54) into the engine case (14) and then to a condensation circuit (66). The engine operates without a boiler and produces 0 steam by injecting water into the generator (12) where it is rapidly vapourized. The rotor (22) is the only moving part and the engine can produce a wide range of power outputs.

13 Claims, 4 Drawing Sheets

WATER-INJECTED STEAM ENGINE

FIELD OF THE INVENTION

The invention pertains to steam engines, and in particular steam engines that operate without a boiler.

BACKGROUND OF THE INVENTION

Steam engines commonly operate by means of a boiler which heats a mass of water to produce steam, which is then directed to a rotor or other mechanism to produce rotary motion.

It is known that the use of boilers can be avoided by means of flash steam generation, in which water is injected into a hot reaction chamber to generate steam by rapid vaporization. Examples of this type of steam engine are disclosed in U.S. Pat. No. 3,720,188 to Mead and CN 102392701 to Tong. The present invention is directed to improvements in this category of steam engines.

SUMMARY OF THE INVENTION

According to one aspect of the invention there is provided a steam engine comprising: (a) an engine case comprising a first section and a second section; (b) a stator between and affixed to the first and second sections of the engine case, the stator having a radially-inner surface defining a plurality of recesses; (c) a steam generator comprising a hollow generator body having a water injection port for entry of water into the generator body and an open outlet end for the release of steam from the generator body, the outlet end being affixed to the first section of the engine case, the steam generator having heating means for generating steam from water in the generator body; (d) a rotor rotatably supported by the engine case, the rotor comprising: (i) a rotor shaft having a hollow section therein comprising a steam distribution chamber, the steam distribution chamber being arranged to receive steam from the outlet end of the steam generator; (ii) a plurality of steam distribution channels extending radially outward from the steam distribution chamber, each channel having an inlet to receive steam from the steam distribution chamber and an outlet for the flow of steam into the stator recesses, the channels being oriented to direct steam into the stator recesses at an angle from the normal; (iii) a plurality of pressure relief ports at a radially outer perimeter of the rotor arranged for the flow of steam from the stator recesses into the engine case; and (e) one or more condensation circuit ports in the engine case for the flow of steam from the engine case to a steam condensation circuit.

According to another aspect of the invention there is provided a steam engine comprising: (a) an engine case; (b) a stator affixed to the engine case, the stator having a radially-inner surface defining a plurality of recesses; (c) a steam generator comprising a hollow generator body having a water injection port for entry of water into the generator body and an open outlet end for the release of steam from the generator body, the outlet end being affixed to the engine case, the steam generator having heating means for generating steam from water in the generator body; (d) a rotor rotatably supported by the engine case, the rotor comprising: (i) a steam distribution chamber arranged to receive steam from the outlet end of the steam generator; (ii) a plurality of steam distribution channels extending radially outward from the steam distribution chamber, each channel having an inlet to receive steam from the steam distribution chamber and an outlet for the flow of steam into the stator recesses; (iii) a plurality of pressure relief ports at a radially outer perimeter of the rotor arranged for the flow of steam from the stator recesses into the engine case; and (e) one or more condensation circuit ports in the engine case for the flow of steam from the engine case.

According to a further aspect of the invention there is provided an apparatus comprising: (a) a steam engine as described above; (b) a condensation circuit operatively connected to the one or more condensation circuit ports for condensing steam produced by the steam engine; (c) a water tank operatively connected to receive water from the condensation circuit; (d) a water pump operatively connected to the water tank and the water injection port of the steam generator to inject water into the steam generator body; and (e) a controller to control the operation of the apparatus.

The steam engine is a substantial improvement over many existing engine designs. It has a single moving part, namely the rotor. It can produce a wide range of power outputs. The design can be readily adapted to smaller and larger embodiments that produce lower or higher power outputs by variation of certain key dimensions of the engine, in particular the volume of the steam distribution chamber, the area of the reaction surfaces and the cross-sectional area of the steam distribution channels. The rotational speed and power output of the engine can be easily controlled by simply regulating the amount or water injected into the steam generator.

These and further aspects of the invention and features of specific embodiments of the invention are described below.

DETAILED DESCRIPTION

Figure 1:
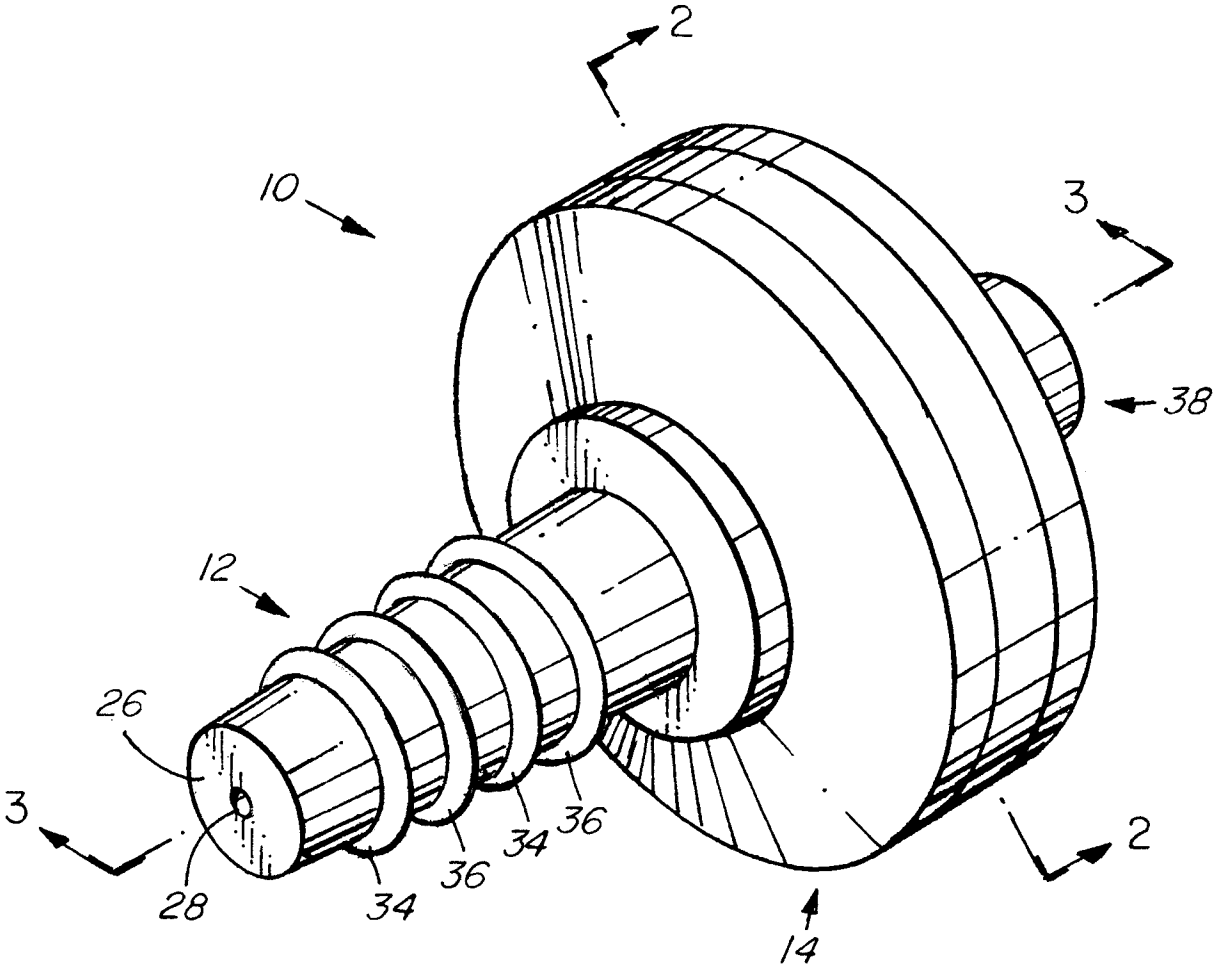
FIG. 1 is a perspective view of a steam engine according to one embodiment of the invention.

The water-injected steam engine 10 comprises as its principal components a steam generator 12, an engine case 14 having a first or forward section 16 and a second or aft section 18, a stator 20 and a rotor 22.

The steam generator 12 comprises a conically-shaped hollow generator body 24. At its forward or input end 26 (the left side in the view of FIGS. 1 and 3), the generator body has a water injection port or inlet 28 for the injection of water into the generator body. At its outlet end 30, the generator body has a circumferential flange 32 by which the steam generator is affixed to the forward section 16 of the engine case. The generator body is open at its outlet end 30 for the release of steam produced in the steam generator.

A water stream dispersion plug 25 at the inlet 28 of the generator body 24 is arranged to divide the injected water stream into a plurality of streams directed to impact the inner walls of the generator body at predetermined points along its length and circumference. This facilitates rapid vapourization within the generator body.

The steam generator 12 has heating means for heating the generator body to generate steam from water that is injected into the generator body. In one embodiment the heating means comprises electrical resistance elements 34 and gas burning nozzles 36, positioned radially around the outer perimeter of the generator body in an alternating arrangement.

The forward engine case section 16 and the aft engine case section 18 are affixed to the stator 20, which is ring-shaped and is arranged between and proximate to the radially outer part of the engine case sections 16, 18. The stator encircles the rotor 22 and acts as a spacer between the forward and aft engine case sections 16, 18.

Figure 3:
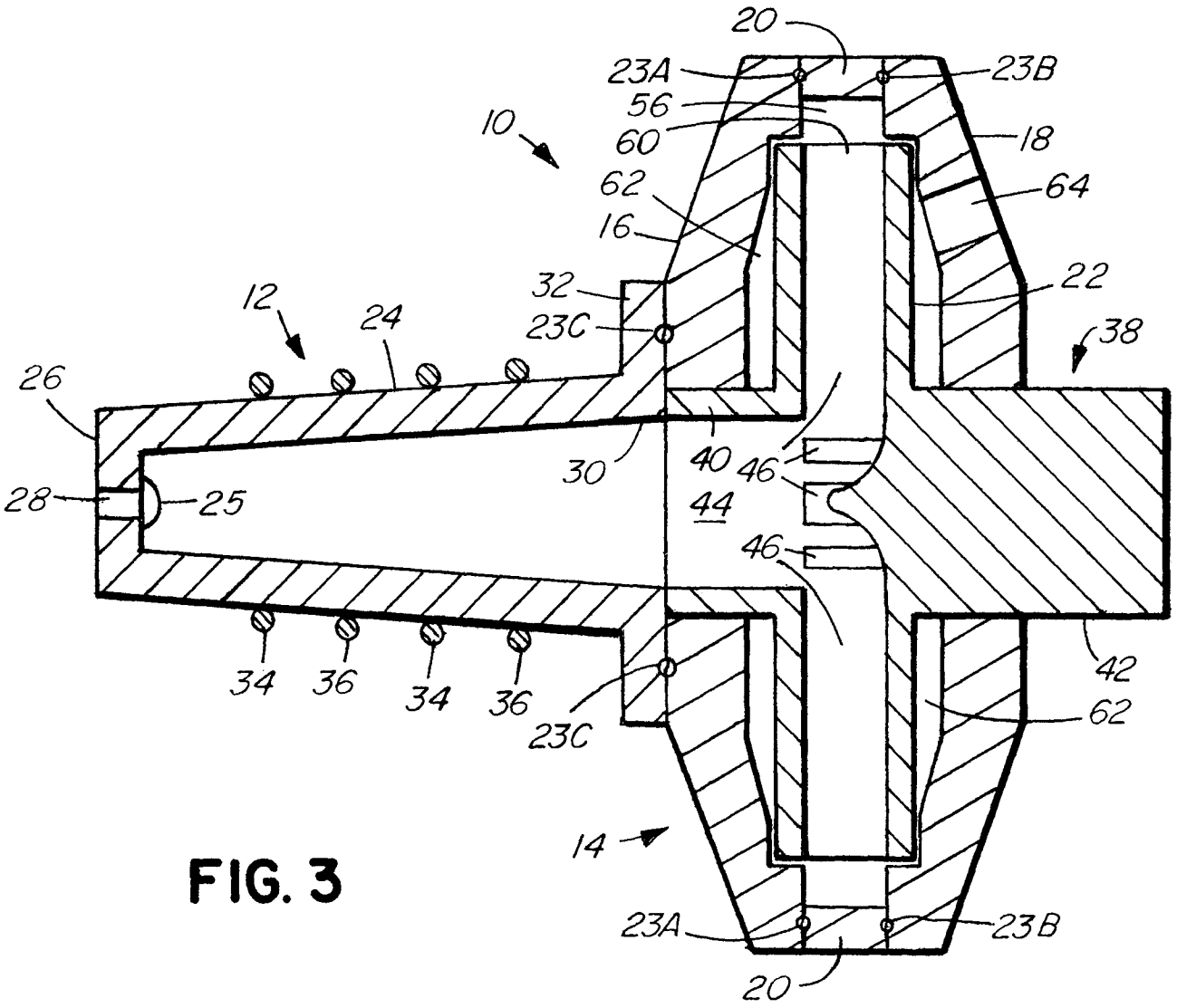
FIG. 3 is a cross-sectional view on the line 3-3 of FIG. 1.
Figure 4:
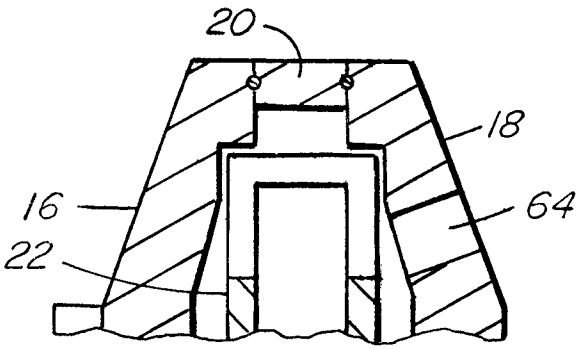
FIG. 4 is a cross-sectional view on the line 4-4 of FIG. 2.

The steam engine 10 includes gaskets to prevent the leakage of steam to the outside of the engine. As shown in FIG. 3, gaskets 23A and 23B provide seals between the stator 20 and the forward engine case section 16 and the aft engine case section 18, respectively. A third gasket 23C provides a seal between the steam generator flange 32 and the forward engine case section 16. These are the only two areas that require gaskets as they are the only points of high pressure steam contact where steam could escape without the proper sealing of the parts. In contrast, internal leakage of steam within the engine flows to the interior of the engine case 14 and does not require seals. The leakage around the outer perimeter of the rotor (i.e., between the rotor and the forward and aft engine case sections) stabilizes the rotor between the engine case sections. The pressure is equal on both sides of the rotor, thereby preventing contact between the rotor and the stationary engine case sections 16, 18. Likewise, leakage between the rotor and the steam generator does not require to be sealed by a gasket. All such internal leakage of steam ultimately flows into the interior space in the engine case 14 and is subsequently recovered in the condensation circuit, as explained below.

The rotor 22 is rotatably supported by the engine case 14. The rotor has a shaft 38 having a forward section 40 supported by the forward engine case section 16 and an aft section 42 supported by the aft engine case section 18. The clearances between the rotor and the engine case sections and the stator permit the rotor to rotate freely about its longitudinal axis. The forward section 40 of the rotor shaft is hollow, forming a steam distribution chamber 44 within the rotor. The steam distribution chamber 44 is aligned with the open outlet end 30 of the steam generator body whereby steam produced in the steam generator flows into the steam distribution chamber 44.

The rotor 22 has a plurality of steam distribution channels 46 arranged radially about the rotor shaft 38. In the illustrated embodiment there are nine channels 46, evenly spaced about the rotor shaft and extending radially outward in a plane perpendicular to the longitudinal axis of the rotor shaft. Each steam distribution channel 46 has an inlet 48 from the steam distribution chamber 44 and an outlet 50 at its radially outer end. The rotor has inner spaces 51 between adjacent steam distribution channels. These spaces 51 are open to the interior 62 of the engine case.

Figure 2:
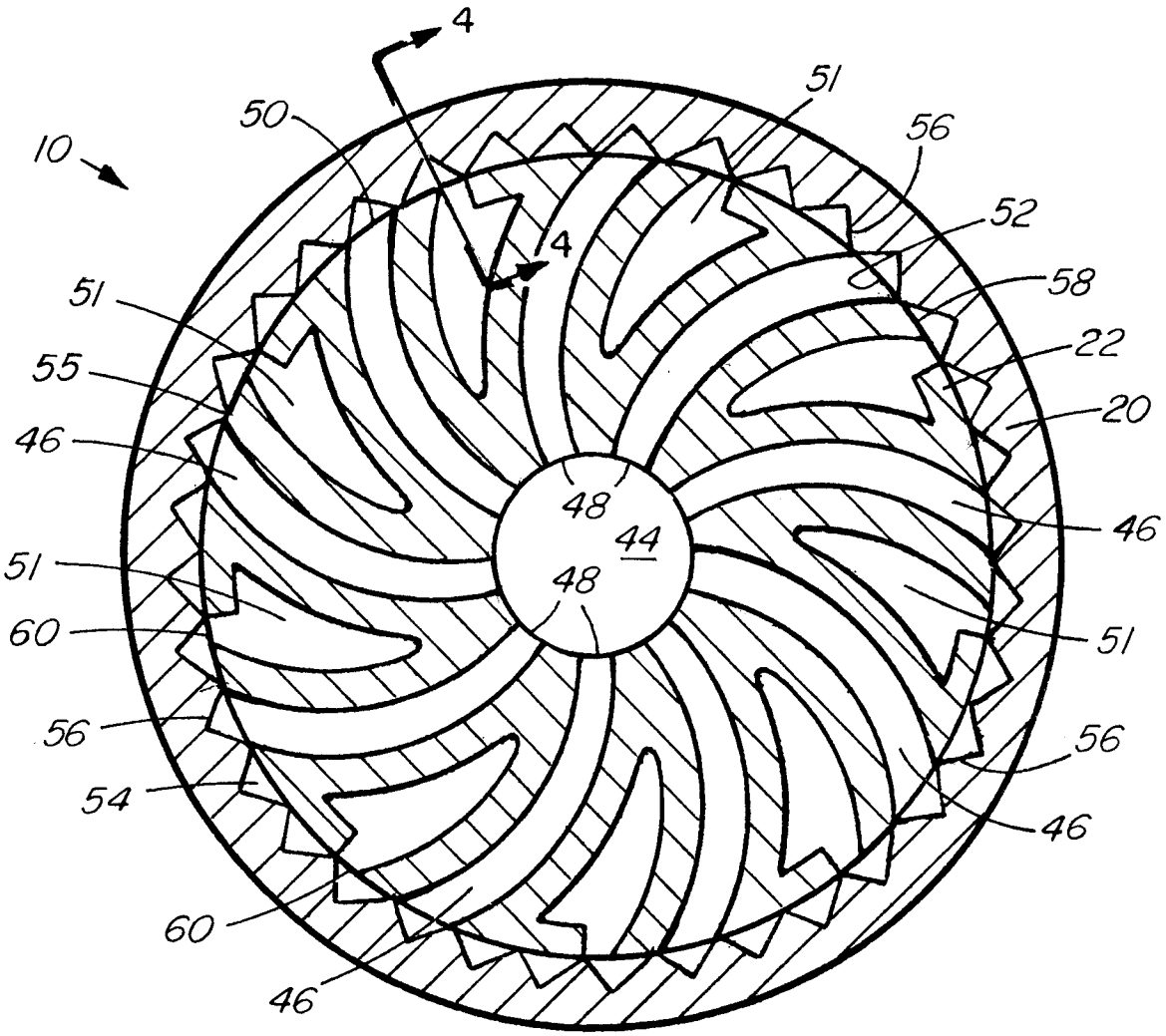
FIG. 2 is a cross-sectional view on the line 2-2 of FIG. 1.

The stator 20 has a radially inner surface 52 which defines a plurality of recesses 54, spaced evenly around the inner surface of the stator. Each recess 54 is separated from an adjacent recess 54 by a short, flat section 55 at the inner surface 52 of the stator. Each recess 54 is shaped so as to have a reaction surface 56 therein, oriented to be approximately perpendicular to the direction of the flow of steam from the outlets 50 of the steam distribution channels 46. The steam distribution channels 46 define a curved path such that steam flowing from the outlets 50 is directed at the inner surface 52 of the stator 20 at an angle from the normal. As seen in FIG. 2, the curved path of the channels 46 and the orientation of the outlets 50 and of the reaction surfaces 56 is such that, in operation, steam flowing from the steam distribution channels into the stator recesses impacts the reaction surfaces 56 at an angle of about 90 degrees and causes the outer perimeter 58 of the rotor to be forced away from the reaction surfaces and rotate the rotor. In the view of FIG. 2, the rotation is in a counterclockwise direction.

The radially outer perimeter 58 of the rotor has a plurality of pressure relief ports 60. These ports provide openings between the stator recesses 54 and the inner spaces 51 of the rotor, which are open to the interior space 62 in the engine case 14, whereby steam in the stator recesses 54 flows into the interior of the engine case. There is one pressure relief port 60 for each steam distribution channel 46. Each pressure relief port 60 is positioned at a suitable distance behind an adjacent steam distribution channel outlet 50 (i.e., is positioned clockwise relative to an adjacent outlet 50 in the view of FIG. 2). The spacing is selected such that steam cannot flow directly from the channel outlet 50 into the adjacent (i.e., clockwise in the view of FIG. 2) pressure relief port 60, and also such that steam does not remain in the stator recess 54 too long before discharging through the pressure relief port 60. In one embodiment, the distance between the trailing edge of each steam distribution channel 46 at the outer perimeter 58 of the rotor 22 and the leading edge of the adjacent pressure relief port 60 is the span of one recess 54. That dimension results in the pressure in the recess 54 being relieved as soon as the trailing edge of the steam distribution channel passes the forward edge of the recess 54.

A plurality of condensation circuit ports 64 in the aft engine case section 18 permit the flow of steam from the engine case to a steam condensation circuit. Sufficient ports 64 are provided to accommodate the volume of steam released into the engine case from the stator recesses 54 without pressurizing the engine case substantially, and also to allow for a rapid steam cooling and condensing cycle. For example, in the illustrated embodiment there may be three or more condensation circuit ports 64, spaced equally apart about the aft engine case section, e.g., 120 degrees apart where there are three ports 64.

Figure 5:
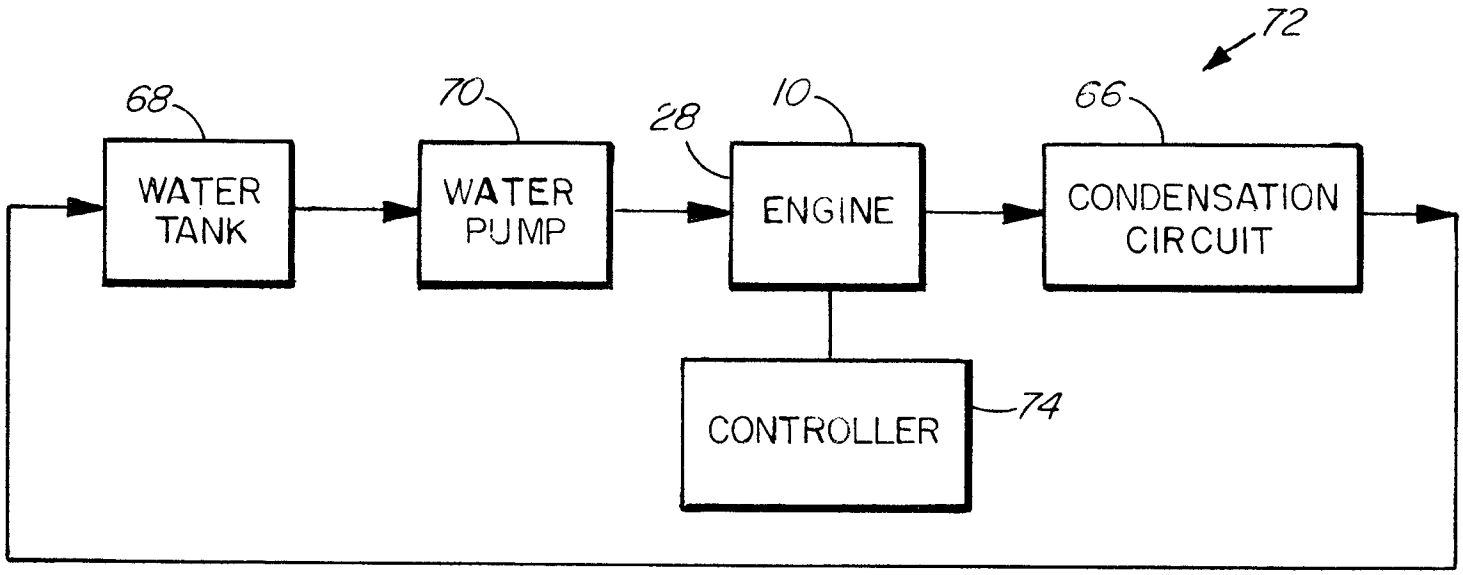
FIG. 5 is a schematic view of the steam engine of FIG. 1 with water injection and steam condensation apparatus.

As shown in the schematic view of FIG. 5, the steam engine 10 is part of an apparatus 72 which includes a condensation circuit 66 for receiving steam from the condensation circuit ports 64 of the engine case, a water tank 68, and a positive displacement pump 70 for injecting water into the steam generator 12. The condensation circuit comprises a condenser and the associated conduits for steam and water. The apparatus includes a controller 74 for controlling the operation of the engine, the condensation circuit and the pump. For example, the controller, which may be a programmable logic computer (PLC) may regulate the temperature, pressure, speed and power output of the engine, and the injection of water by the pump.

The steam engine 10 is operated according to the following method. The heating elements 34, 36 are actuated to raise the temperature of the steam generator 12 to a predetermined level. Water from the water tank 68 is injected by the pump 70 into the steam generator body 24 through the injection port 28, where it is divided into a plurality of streams by the water dispersion plug 25 and is instantly vaporized to steam. The steam generator is operated at high temperatures to produce a high expansion ratio from liquid to vapour. For example, at 636° F. (356° C.), the expansion ratio of water to steam is 2000:1, producing an absolute pressure of 2002.8 psi (13,809 kPa). Examples of suitable operating temperatures for the steam engine are in the range of 500 to 700° F. (260 to 371° C.), alternatively 600 to 696° F. (316 to 369° C.), though it can operate at substantially lower and higher temperatures. The expanding steam in the steam generator 12 is forced into the steam distribution chamber 44 and steam distribution channels 46, into the stator recesses 54 where it impacts the reaction surfaces 56, causing rotation of the rotor 22. As the rotor rotates, the steam flows from the stator recesses 54 through the pressure relief ports 60 into the spaces 51 in the rotor and into the interior space 62 of the engine case 14, and then out of the engine case through the condensation circuit ports 64. In the condensation circuit 66 the steam is condensed to water and is returned to the water tank. Once a cycle of forcing the steam through the engine and recover condensate in the condensation circuit is complete, the working components of the engine have been heated to the selected operating temperature, which is then maintained during the operation of the engine.

In the operation of the steam engine, power control may be achieved simply by regulating the amount of water injected into the steam generator 12 in relation to the speed (rpm) set by a throttle. For example, where the steam engine 10 is used to power a vehicle, if the rpm drops (e.g., when the vehicle is going up a hill), then more water is injected into the steam generator, and if the rpm increases over the throttle settling (e.g., when the vehicle is coasting on level ground or going downhill) then the amount of water injected into the steam generator is reduced. The engine does not slow the vehicle when the power is reduced as there is no compression cycle like a piston engine. In that situation, the rotor would simply be driven by the wheels.

EXAMPLES

Example 1

A steam engine 10 in accordance with one embodiment of the invention has a diameter of about 8 inches (20.3 cm) and a length (not including the steam generator) of about 6 inches (15.2 cm). The steam generator 12 is conical with a length of about 8 inches (20.3 cm). The rotor 22 has a diameter of about 6 inches (15.2 cm) and nine steam distribution channels 46. Each reaction surface 56 is 0.25 square inches (1.61 $cm^2$), for a total reaction surface area as the rotor rotates of 2.25 square inches (14.5 $cm^2$) (9×0.25=2.25). The stator 20 has thirty-six recesses 54, each separated by flat sections 55 that are 0.024 inches (0.061 cm) wide. The steam engine weighs about 60 pounds (27.2 kg). It operates at a steam temperature in the range of 500 to 700° F. (260 to 371° C.), a steam pressure in the range of 1543 to 3013 psi (10,639 to 20,774 kPa), and an operating speed in the range of 10 to 30,000 rpm. At 1000 rpm, the engine produces power in the range of 165 to 322 horsepower (123 to 240 kW) and torque in the range of 868 to 1695 lb-ft (1180 to 2305 Nm). At a steam pressure of 3000 psi (20,684 kPa) and speed of 10,000 rpm it produces about 5300 horsepower (4698 kW). The steam engine can operate at pressures as low as 300 psi (2068 kPa).

The stator recesses 54 are approximately 1/16 cubic inch each (1.02 $cm^3$), resulting in 2.268 cubic inches (37.16 $cm^3$) of recess volume that is pressurized and unloaded 324 times per revolution (nine steam distribution channels times thirty-six recesses), which in turn equals 2268 cubic inches (37,166 $cm^3$) of steam at 1000 rpm. One cubic inch (16.4 $cm^3$) of water equals 3000 cubic inches (49,161 $cm^3$) of steam at 700° F. (371° C.) so in order for the engine to operate at 1000 rpm, it requires about one cubic inch (16.4 $cm^3$) of water to be vapourized every minute or about 0.017 cubic inches (0.278 $cm^3$) per second. At 10,000 rpm, the volume is ten times greater or about 1.7 cubic inches (27.8 $cm^3$) of water per second.

Example 2

In another embodiment of the steam engine 10, the reaction surface areas 56 are increased by 50% relative to Example 1 to 0.375 square inches (2.42 $cm^2$), for a total reaction surface area of 3.375 square inches (21.77 $cm^2$). The rotor has the same diameter and number of steam distribution channels as in Example 1. The length of the engine is increased by 0.250 inches (0.64 cm) due to the wider reaction surface area and wider steam distribution channels. The diameter of the forward section 40 of the rotor shaft is increased to increase the size of the steam distribution chamber, and the aft section 42 of the rotor shaft is increased for the higher power resulting from the expanded reaction surface area. The engine operates at a steam temperature in the range of 500 to 700° F. (260 to 371° C.) and a steam pressure in the range of 1543 to 3013 psi (10,639 to 20,774 kPa). At 1000 rpm, the engine produces power in the range of 248 to 538 horsepower (185 to 401 kW) and torque in the range of 1085 to 2825 lb-ft (1476 to 3842 Nm).

Throughout the foregoing description and the drawings, specific details have been set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

As will be apparent to those skilled in the art in the light of the foregoing disclosure, many alterations and modifications are possible in the practice of this invention without departing from the scope thereof. Accordingly, the scope of the invention is to be construed in accordance with the following claims.

The invention claimed is:

1. A steam engine comprising:

(a) an engine case comprising a first section and a second section;

(b) a stator between and affixed to the first section and the second section of the engine case, the stator having a radially-inner surface defining a plurality of recesses;

(c) a steam generator comprising a hollow generator body having a water injection port for entry of water into the generator body and an open outlet end for the release of steam from the generator body, the outlet end being affixed to the first section of the engine case, the steam generator having heating means for generating steam from water in the generator body;

(d) a rotor rotatably supported by the engine case, the rotor comprising:

(i) a rotor shaft having a hollow section therein comprising a steam distribution chamber, the steam distribution chamber being arranged to receive steam from the outlet end of the steam generator;

(ii) a plurality of steam distribution channels extending radially outward from the steam distribution chamber, each channel having an inlet to receive steam from the steam distribution chamber and an outlet for the flow of steam into the stator recesses, the channels being oriented to direct steam into the stator recesses at an angle from the normal;

(iii) a plurality of pressure relief ports at a radially outer perimeter of the rotor arranged for the flow of steam from the stator recesses into the engine case; and (e) one or more condensation circuit ports in the engine case for the flow of steam from the engine case to a steam condensation circuit.

2. A steam engine according to claim 1, wherein the steam distribution channels follow a curved path from the steam distribution chamber to the radially outer perimeter of the rotor.

3. A steam engine according to claim 1, wherein the steam distribution channels extend radially outward in a plane perpendicular to a longitudinal axis of the rotor shaft.

4. A steam engine according to claim 1, wherein the stator recesses have reaction surfaces therein oriented to be impacted by steam flowing from the steam distribution channels.

5. A steam engine according to claim 4, wherein the reaction surfaces are oriented to be impacted by the steam at an angle of about 90 degrees.

6. A steam engine according to claim 1, wherein the pressure relief ports are in an alternating arrangement with the outlets of the steam distribution channels.

7. A steam engine according to claim 1, wherein the steam generator is conical in shape.

8. A steam engine according to claim 1, further comprising means proximate to the water injection port for dividing a stream of injected water into a plurality of streams directed to impact an inner wall of the generator body.

9. A steam engine according claim 1, wherein the condensation circuit ports are in the second section of the engine case.

10. A steam engine according to claim 7, wherein the steam generator has an input end having a smaller diameter than the output end, and wherein the water injection port is located at the input end.

11. A steam engine according to claim 1, wherein the steam engine has an operating temperature in the range of 600 to 696° F.

12. A steam engine comprising:

(a) an engine case;

(b) a stator affixed to the engine case, the stator having a radially-inner surface defining a plurality of recesses;

(c) a steam generator comprising a hollow generator body having a water injection port for entry of water into the generator body and an open outlet end for the release of steam from the generator body, the outlet end being affixed to the engine case, the steam generator having heating means for generating steam from water in the generator body;

(d) a rotor rotatably supported by the engine case, the rotor comprising:

(i) a steam distribution chamber arranged to receive steam from the outlet end of the steam generator;

(ii) a plurality of steam distribution channels extending radially outward from the steam distribution chamber, each channel having an inlet to receive steam from the steam distribution chamber and an outlet for the flow of steam into the stator recesses;

(iii) a plurality of pressure relief ports at a radially outer perimeter of the rotor arranged for the flow of steam from the stator recesses into the engine case; and (e) one or more condensation circuit ports in the engine case for the flow of steam from the engine case.

13. An apparatus comprising:

(a) a steam engine according to claim 1;

(b) a condensation circuit operatively connected to the one or more condensation circuit ports for condensing steam produced by the steam engine;

(c) a water tank operatively connected to receive water from the condensation circuit;

(d) a water pump operatively connected to the water tank and the water injection port of the steam generator to inject water into the steam generator body; and (e) a controller to control the operation of the apparatus.

* * * * *